US010759641B1

(12) United States Patent
Whetstine et al.

(10) Patent No.: US 10,759,641 B1
(45) Date of Patent: Sep. 1, 2020

(54) PROTECTIVE LIFT PAD FOR MATERIALS HANDLING VEHICLE

(71) Applicant: ReEnvision Products, LLC, Fort Mill, SC (US)

(72) Inventors: Robert David Whetstine, Charlotte, NC (US); Eric Oscar Swanson, Sr., Tega Cay, SC (US)

(73) Assignee: ReEnvision Products, LLC, Fort Mill, SC (US)

( * ) Notice: Subject to any disclaimer, the term of this patent is extended or adjusted under 35 U.S.C. 154(b) by 309 days.

(21) Appl. No.: 15/870,034

(22) Filed: Jan. 12, 2018

Related U.S. Application Data

(60) Provisional application No. 62/445,514, filed on Jan. 12, 2017.

(51) Int. Cl.
*B66F 9/12* (2006.01)

(52) U.S. Cl.
CPC ..... *B66F 9/12* (2013.01)

(58) Field of Classification Search
CPC ..... B66F 9/12; E01F 15/141; E01F 15/143; E01F 15/145; E01F 15/146; E01F 15/148; B60R 2019/1886; B60R 2019/247; B60R 19/24; B60R 19/38
See application file for complete search history.

(56) References Cited

U.S. PATENT DOCUMENTS

| | | | | |
|---|---|---|---|---|
| 3,080,080 | A | 3/1963 | Miller | |
| 3,610,609 | A | 10/1971 | Sobel | |
| 4,061,385 | A * | 12/1977 | Schwartzberg | B60R 19/20 293/107 |
| 4,102,464 | A * | 7/1978 | Schuster | B66F 9/12 293/107 |
| 5,174,710 | A | 12/1992 | Dragos | |
| 5,897,286 | A * | 4/1999 | Whittaker | B66F 9/12 187/237 |
| 8,267,262 | B2 * | 9/2012 | Thelwell | B65G 1/02 211/183 |
| 9,752,291 | B2 * | 9/2017 | Michael | E01F 15/141 |
| 2004/0161327 | A1 * | 8/2004 | Paxton | B66F 9/12 414/785 |

* cited by examiner

*Primary Examiner* — Minh Truong
(74) *Attorney, Agent, or Firm* — Schwartz Law Firm, P.C.

(57) ABSTRACT

A protective lift pad is located on a mechanical lift of a materials handling vehicle, and is adapted for engaging and protecting materials carried by the vehicle. The lift pad includes a flexible polymeric body. A plurality of magnets are embedded within the flexible body, and are adapted for releasably magnetically mounting the lift pad to a metal surface on a vertical back of the mechanical lift.

20 Claims, 7 Drawing Sheets

PROTECTIVE LIFT PAD FOR MATERIALS HANDLING VEHICLE

TECHNICAL FIELD AND BACKGROUND OF THE INVENTION

This application relates broadly and generally to a protective lift pad; and in exemplary embodiments described further herein, to a protective "bumper" pad designed for engaging and protecting materials carried by a materials handling vehicle, such as those utilizing a mechanical forklift. The exemplary pad is designed to protect materials from damage resulting from impact against the fork backrest. In many cases, even slight to moderate damage to fragile edges during handling can render the entire product unfit for commercial sale.

Forklift damage to materials in industrial warehouses and home improvement stores is substantial—estimated to be in the millions of dollars each year. In most home improvement stores, forklift operators have relatively little experience or formal training in the operation and maneuvering of lift trucks. When approaching a loaded pallet for transport, an operator will typically move the truck forward until the forks have clearly and firmly impacted the materials. While this ensures full extension of the fork tines into the pallet, the impact often damages the materials. Inherence sight limitations of the operator related to his physical position during operation of the forklift further contribute to the problem.

One prior art solution to this problem is to locate an impact sensor on the forkback of the lift truck. If the fork is bumped beyond the selected impact level, the sensor sounds an internal audible alarm. The sensor is intended to limit careless operation of the lift truck and create a safer, more efficient and productive work environment. A significant disadvantage of this attempted solution is that after the impact is made and the alarm sounds the materials damage has already occurred. Another solution is to provide better training and orientation programs for the vehicle operators. However, even for those most qualified operators, unavoidable circumstances and accidents will nevertheless occur in a certain percentage of runs.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a materials handling vehicle with a mechanical lift including a horizontal extension and a vertical back. A protective lift pad is located on the mechanical lift, and is adapted for engaging and protecting materials carried by the vehicle. The protective lift pad comprises a flexible polymeric (or other cushioning) body having opposing first and second end edges defining therebetween a length of the body, and opposing first and second side edges defining therebetween a width of the body. A plurality of magnets are embedded within the flexible body, and are adapted for releasably magnetically mounting the protective lift pad to a metal surface on the vertical back of the mechanical lift. First and second opposing end flanges extend planarly outwardly from respective first and second end edges of the flexible body. A raised front engagement panel is located between opposing end flanges, and is spaced apart from opposing side edges of the flexible body. At least one vertical alignment tab is located along one of the first and second side edges of the flexible body. The alignment tab extends perpendicularly rearward from the body to reside adjacent an edge of the vertical back of the mechanical lift. The term "perpendicularly rearward" means extending in a rearward direction generally 90 degrees to a major planar surface of the flexible body.

According to another exemplary embodiment, the flexible body comprises an injection molded homogenous construction.

According to another exemplary embodiment, a perimeter margin is formed around the front engagement panel.

According to another exemplary embodiment, the perimeter margin has a uniform dimension of less than 1.0 inch.

According to another exemplary embodiment, each end flange extends planarly outward from the flexible body a distance substantially equal to the dimension of the perimeter margin. As used herein, the term "planarly outward" means extending in a direction co-planar with a major planar surface of the flexible body, or within a plane substantially parallel to a major planar surface of the flexible body.

According to another exemplary embodiment, the alignment tab is formed substantially flush to the side edge of the flexible body.

According to another exemplary embodiment, the alignment tab extends perpendicularly rearward from the flexible body a distance less than 1.0 inch.

According to another exemplary embodiment, a plurality of integrally-molded magnet sockets are formed with an underside of the flexible body.

According to another exemplary embodiment, each of the magnets is carried in an annular metal housing.

According to another exemplary embodiment, an embedment disk is spaced apart from and connected to the magnet housing, and is integrally molded within the flexible body to permanently affix the magnets/magnet housings to the protective pad.

According to another exemplary embodiment, the mechanic lift comprises a pair of laterally spaced forks. Each fork comprises a vertical metal backrest, an elbow, and an elongated horizontal tine. The lift pad is releasably magnetically mounted to the vertical metal backrest of the fork.

According to another exemplary embodiment, the width of the flexible body is substantially equal to a width of the vertical backrest of the fork.

According to another exemplary embodiment, the lift pad extends vertically upward from the elbow of the fork.

According to another exemplary embodiment, a grid structure is integrally molded with an underside of the flexible body.

According to another exemplary embodiment, the length of the flexible body is greater than 4 times the width of the flexible body.

In another exemplary embodiment, the present disclosure comprises a protective lift pad designed for engaging and protecting materials carried by a materials handling vehicle using a mechanical lift.

In yet another exemplary embodiment, the present disclosure comprises a method for minimizing damage to materials carried on a mechanical lift of a materials handling vehicle. The mechanical lift includes a horizontal extension and a vertical back. The method includes the step of locating a protective lift pad adjacent the vertical back.

In one or more exemplary embodiments, it is an object of the disclosure to provide a protective lift pad adapted for engaging and protecting materials carried by a materials handling vehicle, thereby reducing materials damage and costs.

In one or more exemplary embodiments, it is another object of the disclosure to provide a protective lift pad which does not interfere with the operator's line of sight.

In one or more exemplary embodiments, it is another object of the disclosure to provide protective lift pad which does not interfere with fork adjustment.

In one or more exemplary embodiments, it is another object of the disclosure to provide protective lift pad which is readily removable, exchangeable and replaceable.

In one or more exemplary embodiments, it is another object of the disclosure to provide a method for protecting materials, such as wallboard, sheet rock, sheet metals, tile board, paneling, foam products, finished woods, acoustical materials, glass, can goods, food products, packaged, unpackaged, and in-process manufactured materials, medical materials and packaging, finished and unfinished goods, and other fragile items commonly carried on mechanical lifts.

In one or more exemplary embodiments, it is another object of the disclosure to provide a materials handling vehicle which incorporates a protective lift pad designed for engaging and protecting materials carried by the vehicle.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
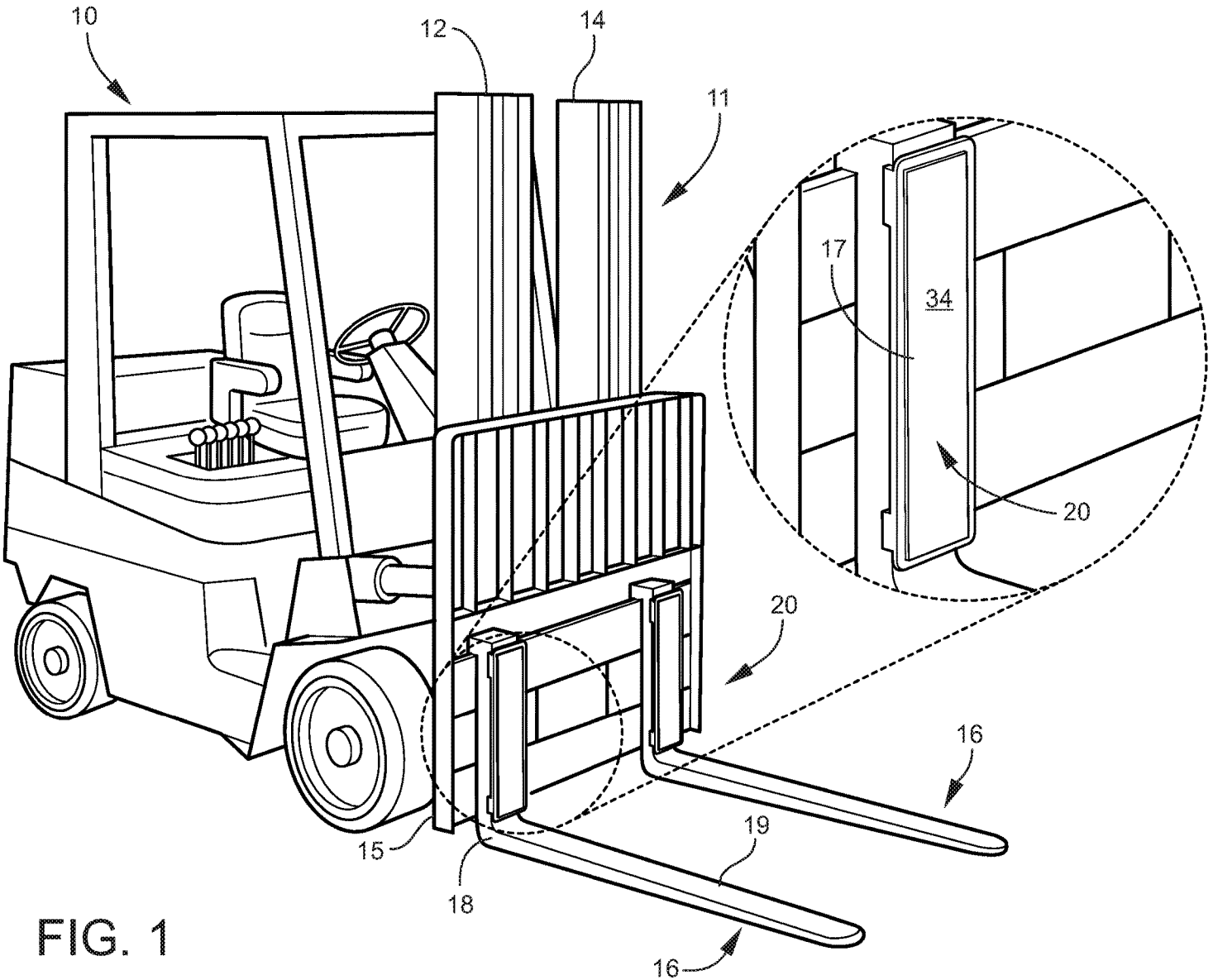
FIG. 1 is a perspective view of materials handing vehicle incorporating a pair of protective lift pads according to one exemplary embodiment of the present disclosure.
Figure 2:
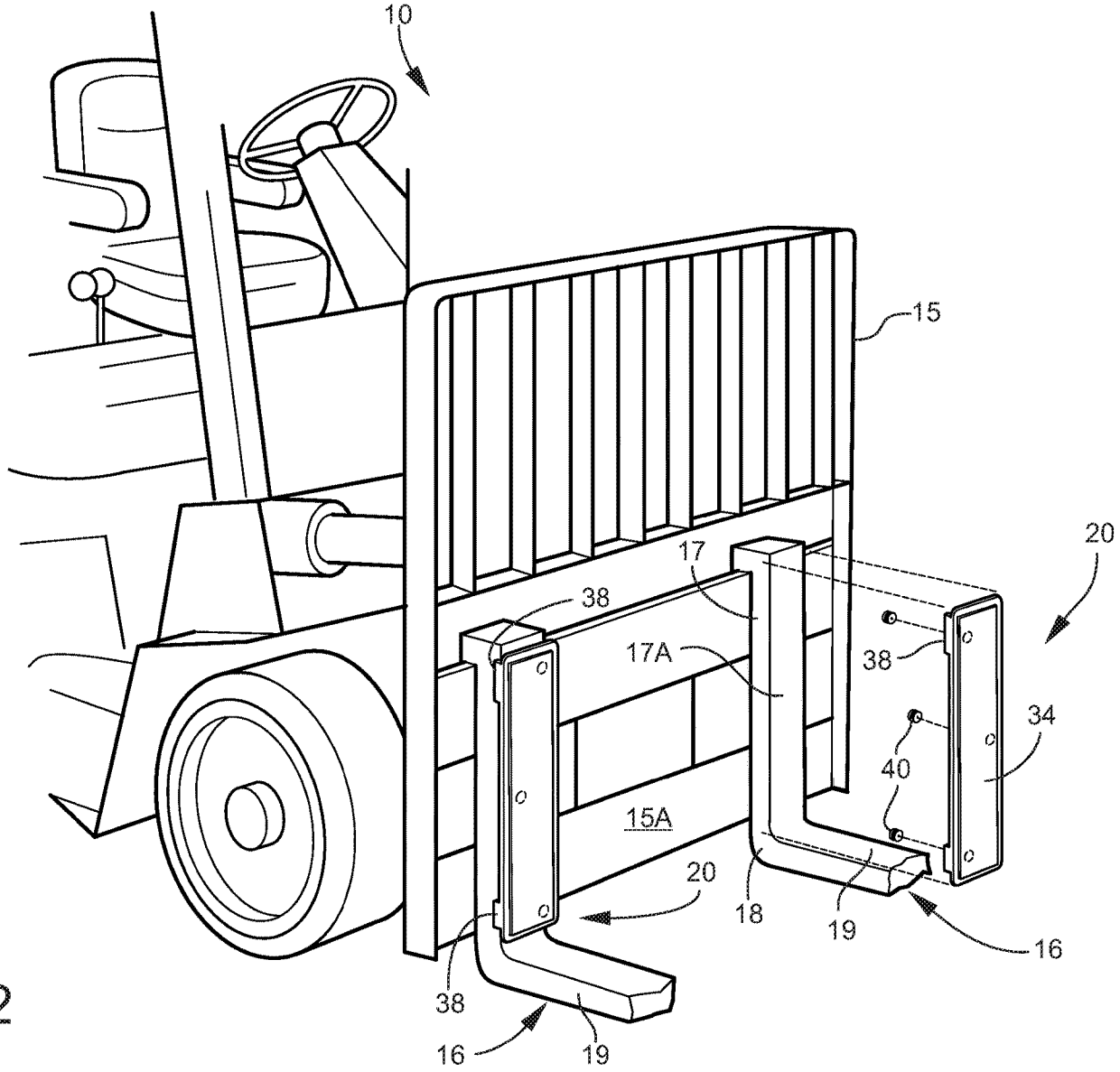
FIG. 2 is a further perspective view of the exemplary materials handing vehicle, and showing the present lift pad and mounting magnets exploded away from the vehicle fork.

Referring now specifically to the drawings, FIGS. 1 and 2 illustrate a materials handling vehicle 10 including one or more protective lift pads 20 according to exemplary embodiments of the present disclosure. The exemplary vehicle 10 incorporates a conventional mechanical lift 11 with spaced vertical masts 12, 14, a carriage 15 designed for upward and downward movement along the masts 12, 14, and a pair of forks 16. Each fork 16 has an integrally-formed vertical metal backrest 17, a transition elbow 18, and an elongated horizontal tine 19. The backrest 17 may be permanently affixed to the carriage 15, and has a thickness which protrudes slightly forward of the carriage front 15A. The forks 16 are especially applicable for collecting building materials, such as sheet rock and wallboard, stacked in a unit load on a wood pallet or other standard carrier. In existing prior art vehicles, the protruding thickness of the vertical backrest is a common source of damage to materials during loading and transport—particularly materials with relatively fragile edges, such as sheet rock and wallboard.

Figure 9:
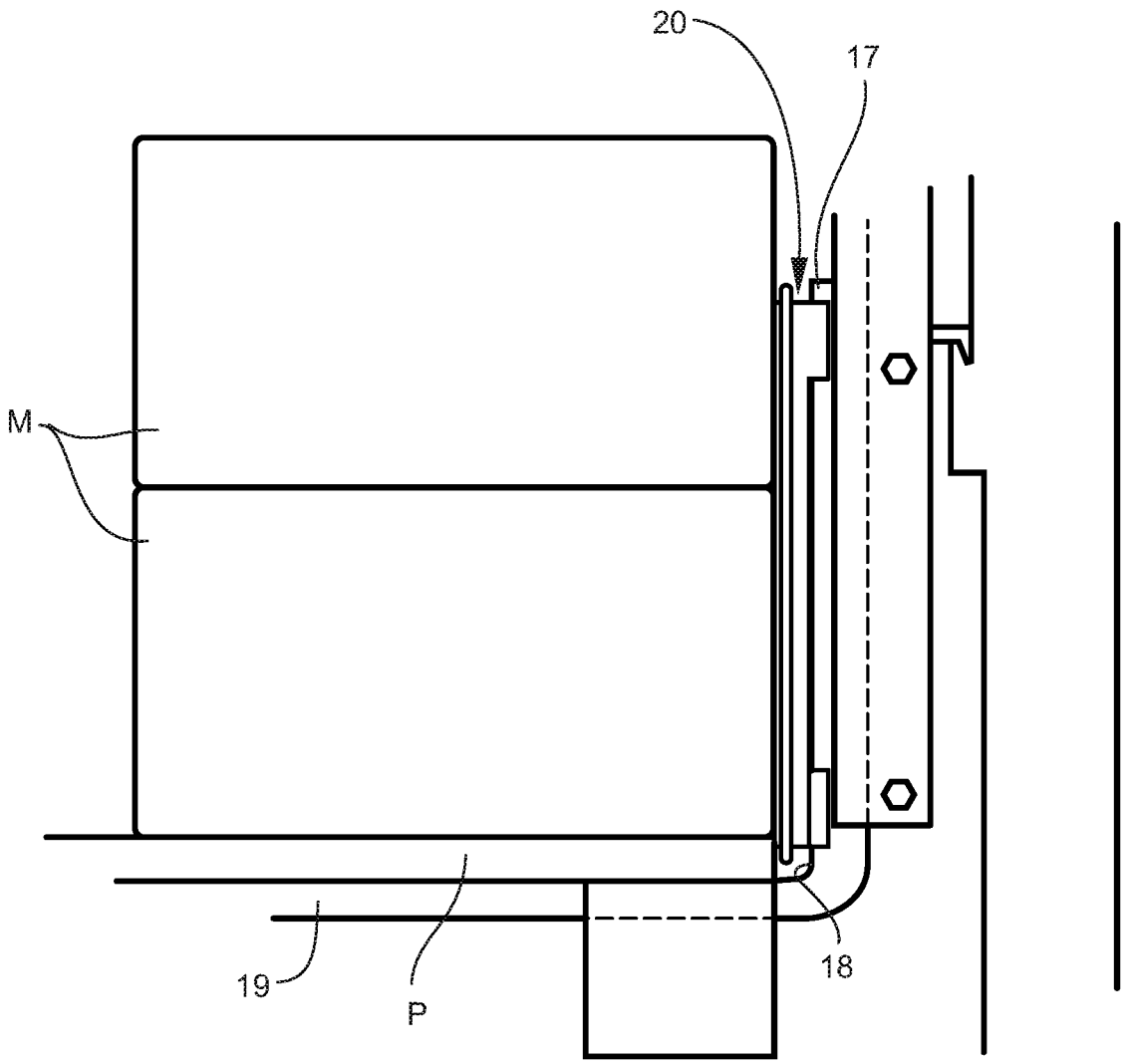
FIG. 9 shows the exemplary lift pad mounted on the vehicle fork and in an exemplary position designed to engage and protect materials carried by the vehicle.

To address this issue, the protective lift pads 20 of the present disclosure releasably magnetically mount to the vertical backrest 17 of one or both metal forks 16, as described further below. When positioned as shown in FIG. 9, the exemplary lift pad(s) 20 engage and cushion materials "M" carried by the vehicle forks 16 on wood pallet "P".

Figure 3:
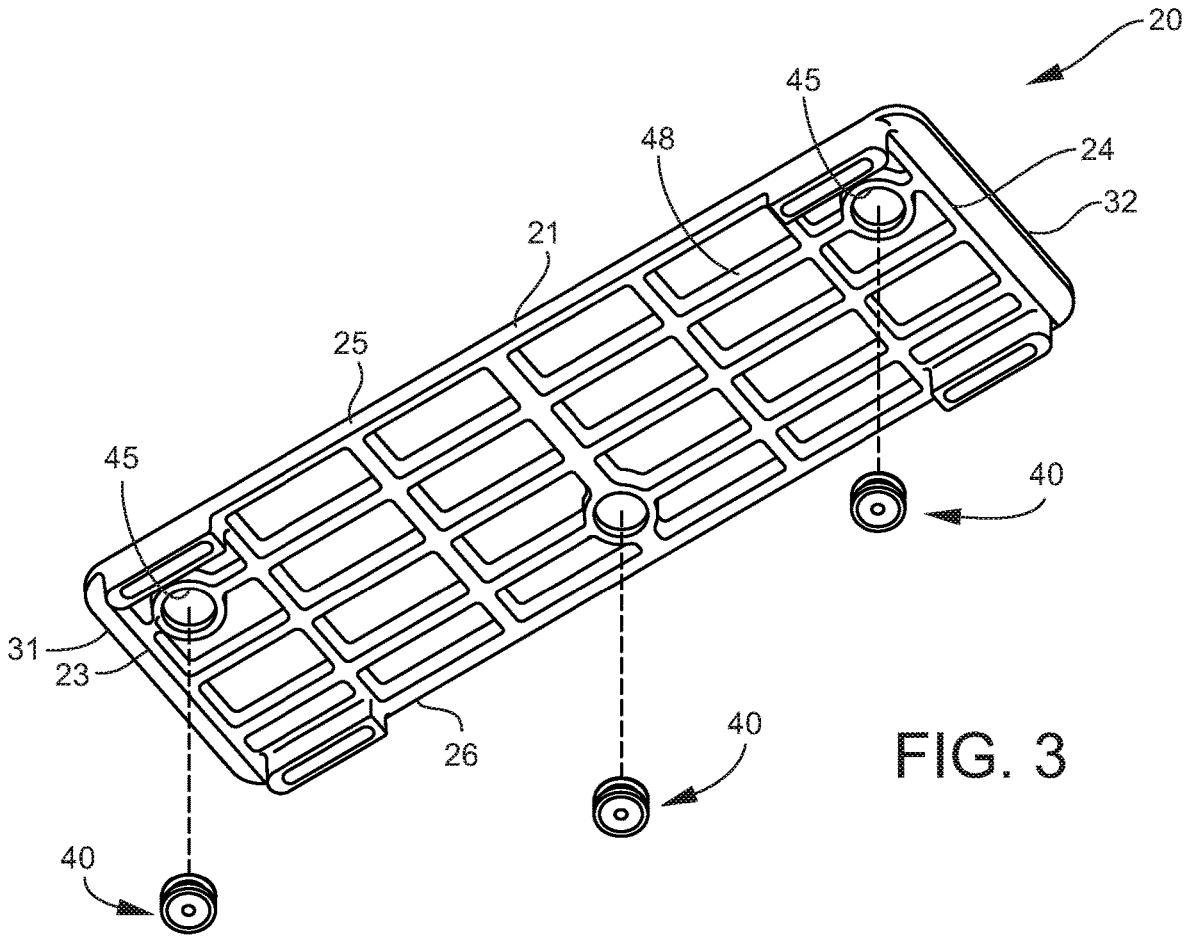
FIG. 3 is an underside perspective view of the exemplary protective lift pad, and showing the mounting magnets exploded away from the flexible body.
Figure 4:
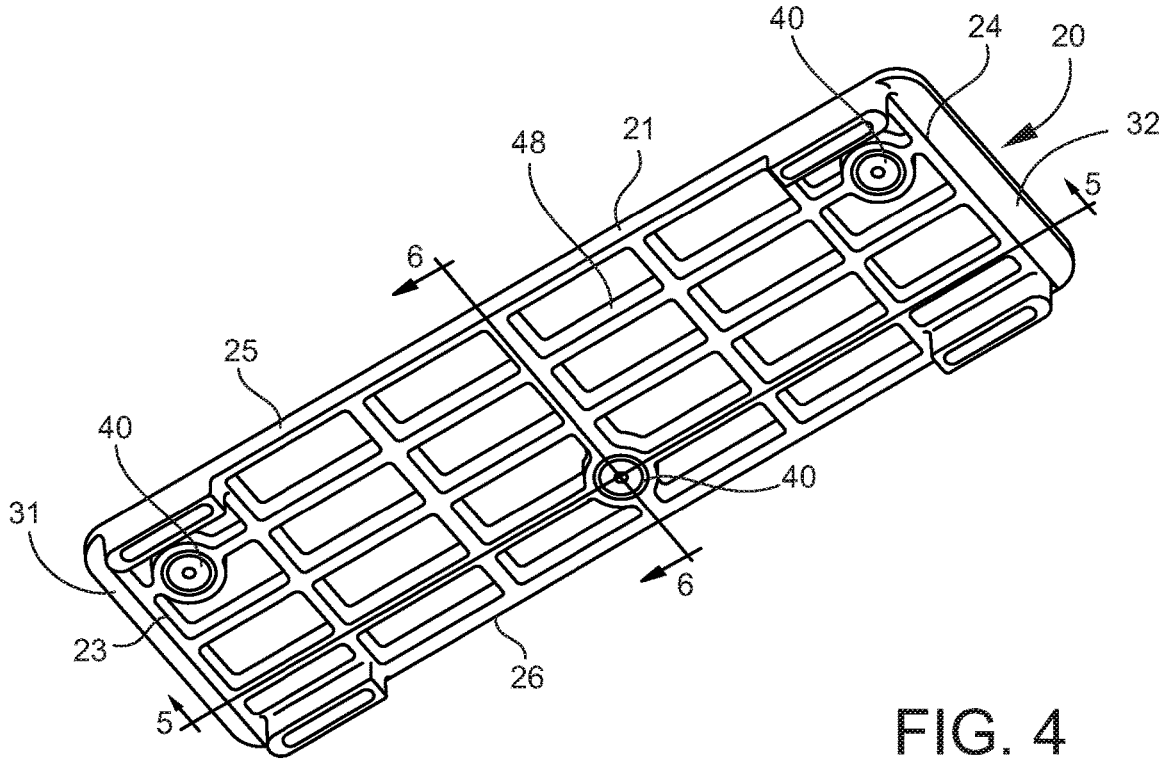
FIG. 4 is a further underside perspective of the exemplary protective lift pad with the mounting magnets embedded in respective sockets formed with the flexible body.

Referring to FIGS. 2, 3, and 4, the exemplary lift pad 20 comprises a flexible polymeric body 21 having opposing first and second end edges 23, 24, and opposing first and second side edges 25, 26. The distance between end edges 23, 24 defines a length of the flexible body 21, while the distance between side edges 25, 26 defines a width of the flexible body 21. The length of the flexible body 21 may be more than 3-4 times its width. In one embodiment, for example, the length is about 20 inches and the width is about 5 inches. For larger size forks, the body dimension may be about 36 inches in length by 8 inches wide, or greater.

Figure 5:
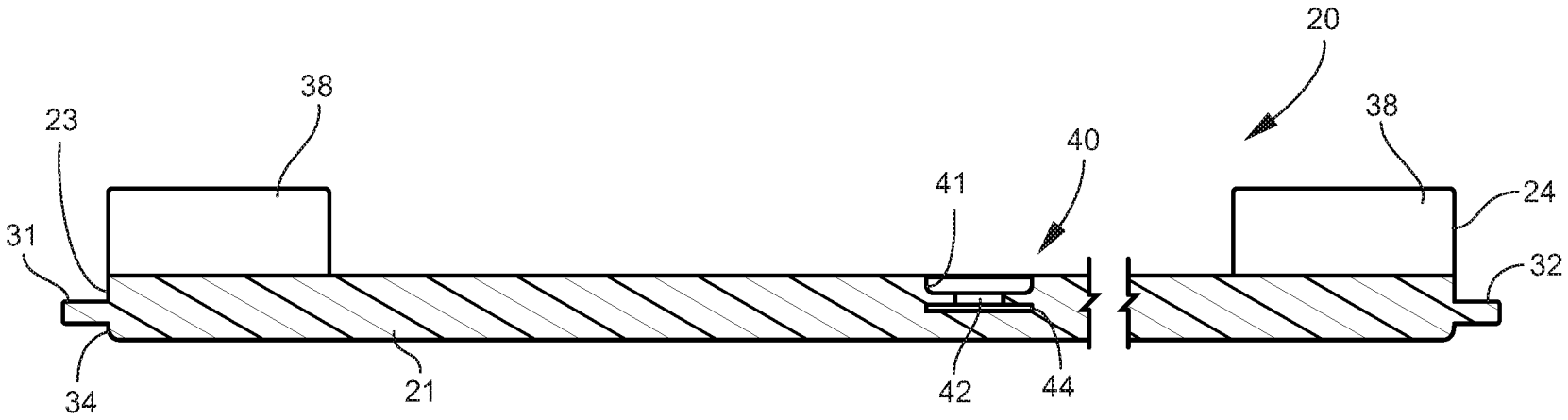
FIG. 5 is a cross-sectional view taken substantially along line 5-5 of FIG. 4.
Figure 6:
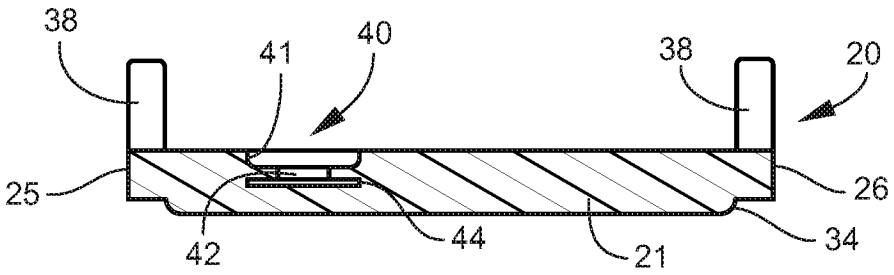
FIG. 6 is a further cross-sectional view taken substantially along line 6-6 of FIG. 4.

As best shown in FIGS. 3 and 5, first and second opposing end flanges 31, 32 are integrally formed with and extend planarly outwardly from respective first and second end edges 23, 24 of the flexible body 21. The end flanges 31, 32 form respective handles for applying and removing the lift pad 20, and provide increased protective coverage along the vertical backrest 17 of the fork 16. A raised front engagement panel 34 (FIGS. 1 and 2) is located between opposing end flanges 31, 32, and is spaced apart from opposing side edges 25, 26 of the flexible body 21. In the exemplary embodiment, the front engagement panel 34 is about 0.25 inches thick and is substantially rectangular with a uniform perimeter margin 35 formed around all four sides. The perimeter margin 35 frames the engagement panel 34 in a front center of the lift pad 20, and may be between about 0.5 and 1.0 inch wide around all sides of the panel 34. As such, each end flange 31, 32 may extend planarly outward from the flexible body 21 a distance corresponding to the uniform width of the perimeter margin 35.

Vertical alignment tabs 38 are located along one or both side edges 25, 26 of the flexible body 21 and extend perpendicularly rearward towards the vehicle 10 to reside adjacent an edge of the fork's vertical backrest 17, as best show in FIGS. 1 and 2. The exemplary alignment tabs 38 are formed substantially flush (or even) with side edges 25, 26 of the flexible body 21, and may be selectively cut and removed along one side edge to allow the lift pad 20 to fit larger size forks 16. The alignment tabs 38 facilitate proper placement of the lift pad 20 on the vehicle fork 16, and are sufficiently long (e.g., between about 0.5 and 1.0 inch) to restrict inadvertent lateral shifting of the pad 20 during use. In one embodiment, the width of the flexible body 21 is substantially equal to the width of the vertical backrest 17 of the vehicle fork 16.

Referring to FIGS. 3-6, a number of magnets 40 (e.g., permanent magnets) function to releasably magnetically mount the protective lift pad 20 to a metal surface on the fork backrest 17. Each magnet 40 is carried in an annular metal housing 41. The magnet housing 41 is connected by reduced diameter metal neck 42 to a metal embedment disk 44—all of which are contained within a molded socket 45 formed with an underside of the flexible body 21. The flexible body 21 may further comprise an integrally-molded underside grid structure 48 designed to promote increased flexibility and strength, and to reduce the overall weight of the lift pad 20. During manufacture, each magnet assembly (including magnet 40, housing 41, neck 42, and embedment disk 44) is first placed in a mold, and a liquid polymer material then injected such that the magnet assembly becomes integrally and permanently embedded within the homogenous material of the flexible body 21. See FIGS. 4, 5 and 6. After the injection-molding process, the magnet and magnet housing may remain partially or entirely exposed, as shown in FIG. 4.

Figure 7:
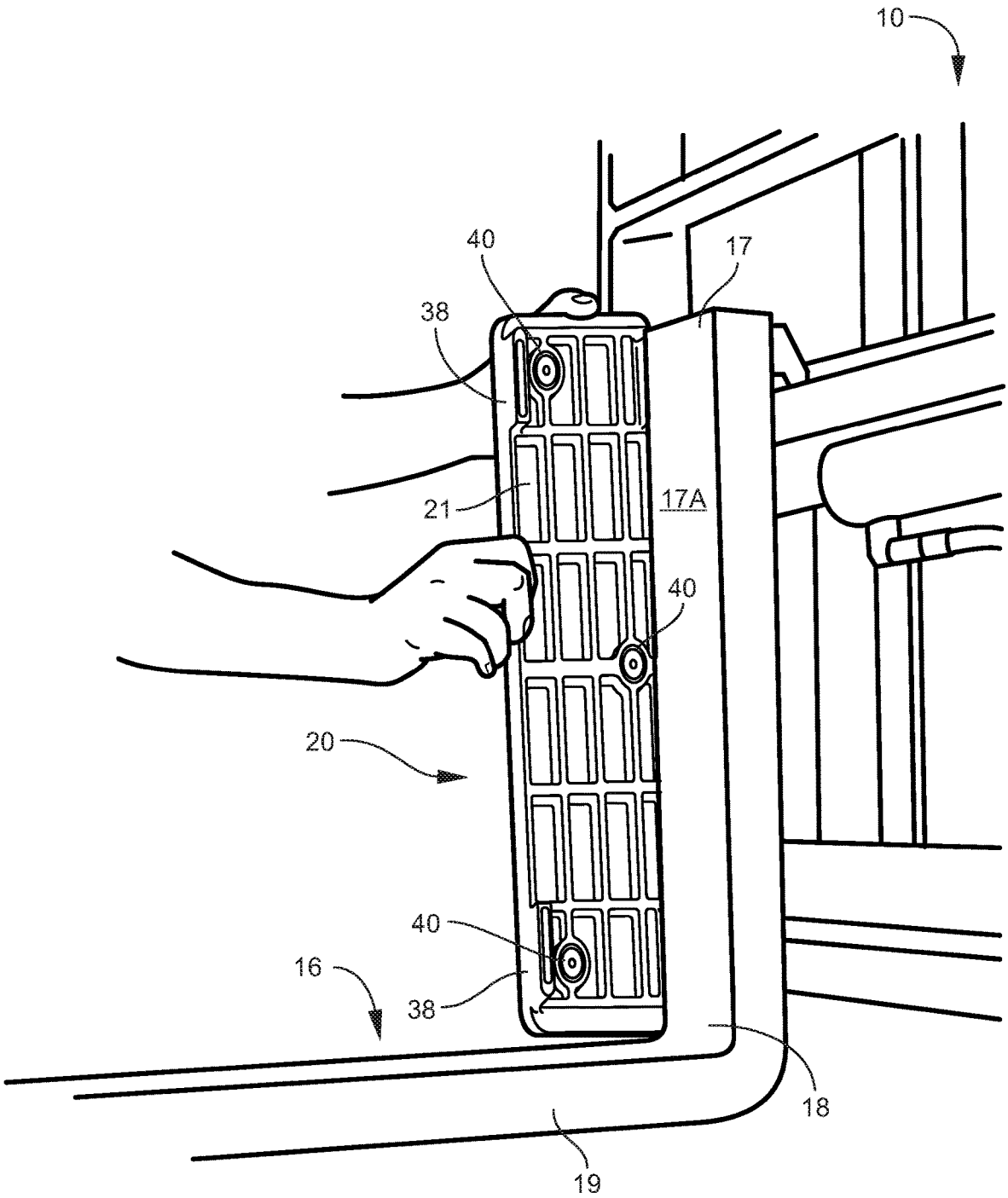
FIG. 7 demonstrates one exemplary technique for applying the present lift pad to the metal backrest of the vehicle fork.
Figure 8:
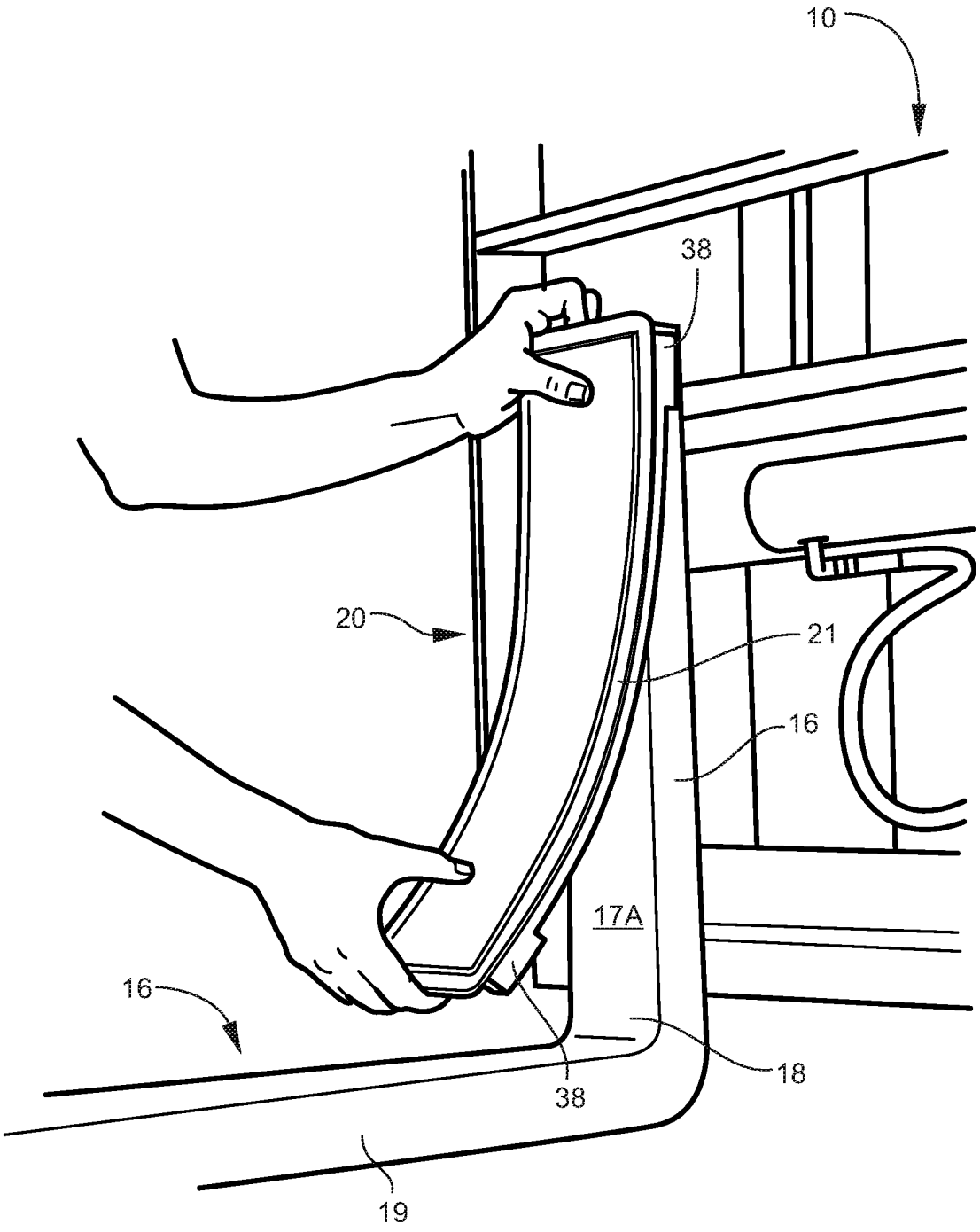
FIG. 8 demonstrates one exemplary technique for removing the present lift pad from the metal backrest of the vehicle fork.

FIGS. 7 and 8 demonstrate installation and removal of the protective lift pad 20 onto and from the materials handing vehicle 10. As shown in FIG. 7, the exemplary lift pad 20 may be installed by first locating the alignment tabs 38 against the vertical edge of the fork's backrest 17, such that the flexible body 21 is angled outwardly from the metal surface 17A to prevent the mounting magnets 40 from engaging. The angled lift pad 20 can then be shifted upward or downward for proper vertical alignment on the metal backrest 17. Once aligned, the flexible body 21 is pivoted inwardly towards the backrest 17 so that the magnets 40 attract and firmly engage the metal surface 17A, thereby releasably locking the protective lift pad 20 in a fixed position. In one exemplary application, the protective lift pad 20 is intended to mount to the metal backrest 17 of the fork 16 just above the horizontal tine 19 and directly adjacent the transition elbow 18. See FIG. 9. Additionally, the "stepped" profile of the lift pad 20 at its bottom end may enable increased protective coverage at the transition elbow 18.

FIG. 8 illustrates an exemplary technique for removing the protective lift pad 20 from the vehicle fork 16. Grasping the top and bottom end flanges 31, 32, the user can pull and separate the mounting magnets 40 from the metal surface 17A of the fork 16, thereby quickly and easily releasing the lift pad 20 from the vehicle 10.

In alternative exemplary embodiments, the protective lift pad 20 may be fabricated of an assembly of individual components, may comprise materials other than polymer, and may be rigid or semi-rigid. The protective lift pad 20 may also be fabricated in any desired shape and dimension. Additionally, one or multiple magnets may be utilized and arranged in any suitable manner to releasably magnetically mount the lift pad to the vehicle fork.

An exemplary embodiment of the protective lift pad is illustrated in the attached drawings and photographs. As best shown in the drawing sheet, to enable convenient exchange and replacement, the protective lift pad is preferably removably attached to the fork backrest using a number of magnets. The drawing sheet further details exemplary dimensions of the present lift pad.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A materials handling vehicle comprising a mechanical lift, the mechanical lift including a horizontal extension and a vertical back, a protective lift pad adapted for engaging and protecting materials carried by said vehicle, said protective lift pad comprising:

a flexible polymeric body having opposing first and second end edges defining therebetween a length of said body, and opposing first and second side edges defining therebetween a width of said body;

a plurality of magnets embedded within said flexible body, and adapted for releasably magnetically mounting said lift pad to a metal surface on the vertical back of said mechanical lift;

first and second opposing end flanges extending planarly outwardly from respective first and second end edges of said flexible body;

a raised front engagement panel located between opposing end flanges and spaced apart from opposing side edges of said flexible body; and at least one vertical alignment tab located along one of the first and second side edges of said flexible body, and extending perpendicularly rearward from said body to reside adjacent an edge of the vertical back of said mechanical lift.

2. The materials handling vehicle according to claim 1, and comprising a perimeter margin formed around said front engagement panel.

3. The materials handling vehicle according to claim 2, wherein said perimeter margin has a uniform dimension of less than 1.0 inch.

4. The materials handling vehicle according to claim 3, wherein each end flange extends planarly outward from said flexible body a distance substantially equal to the dimension of said perimeter margin.

5. The materials handling vehicle according to claim 1, wherein said alignment tab is formed substantially flush to the side edge of said flexible body.

6. The materials handling vehicle according to claim 5, wherein said alignment tab extends perpendicularly rearward from said flexible body a distance less than 1.0 inch.

7. The materials handling vehicle according to claim 1, and comprising a plurality of integrally-molded magnet sockets formed with an underside of said flexible body.

8. The materials handling vehicle according to claim 1, wherein each of said magnets is carried in an annular metal housing.

9. The materials handling vehicle according to claim 8, and comprising an embedment disk spaced apart from and connected to said magnet housing, and molded within said flexible body.

10. The materials handling vehicle according to claim 1, wherein said mechanic lift comprises a pair of laterally spaced forks, each fork comprising a vertical metal backrest, an elbow, and an elongated horizontal tine, and wherein said lift pad is releasably magnetically mounted to the vertical metal backrest of said fork.

11. The materials handling vehicle according to claim 10, wherein the width of said flexible body is substantially equal to a width of the vertical backrest of said fork.

12. The materials handling vehicle according to claim 10, wherein said lift pad extends vertically upward from the elbow of said fork.

13. The materials handling vehicle according to claim 1, and comprising a grid structure integrally molded with an underside of said flexible body.

14. The materials handling vehicle according to claim 1, wherein the length of said flexible body is greater than 4 times the width of said flexible body.

15. A protective lift pad designed for engaging and protecting materials carried by a materials handling vehicle comprising a mechanical lift, the mechanical lift including a horizontal extension and a vertical back, said protective lift pad comprising:

a flexible polymeric body having opposing first and second end edges defining therebetween a length of said body, and opposing first and second side edges defining therebetween a width of said body;

a plurality of magnets embedded within said flexible body, and adapted for releasably magnetically mounting said lift pad to a metal surface on the vertical back of said mechanical lift;

first and second opposing end flanges extending planarly outwardly from respective first and second end edges of said flexible body;

a raised front engagement panel located between opposing end flanges and spaced apart from opposing side edges of said flexible body; and at least one vertical alignment tab located along one of the first and second side edges of said flexible body, and extending perpendicularly rearward from said body to reside adjacent an edge of the vertical back of said mechanical lift.

16. The protective lift pad according to claim 15, wherein each end flange extends planarly outward from said flexible body a distance substantially equal to the dimension of said perimeter margin.

17. The protective lift pad according to claim 15, and comprising a plurality of integrally-molded magnet sockets formed with an underside of said flexible body.

18. The protective lift pad according to claim 15, wherein each of said magnets is carried in an annular metal housing.

19. The protective lift pad according to claim 18, and comprising an embedment disk spaced apart from and connected to said magnet housing, and molded within said flexible body.

20. The protective lift pad according to claim 15, and comprising a grid structure integrally molded with an underside of said flexible body.

* * * * *